US008000882B2

(12) United States Patent
Ramappan et al.

(10) Patent No.: US 8,000,882 B2
(45) Date of Patent: Aug. 16, 2011

(54) ACTIVE COMBUSTION CONTROL BASED ON RINGING INDEX FOR REDUCING HOMOGENOUS CHARGE COMPRESSION IGNITION (HCCI) COMBUSTION NOISE

(75) Inventors: Vijay Ramappan, Novi, MI (US); Jun-Mo Kang, Ann Arbor, MI (US)

(73) Assignee: GM Global Technology Operations LLC

( * ) Notice: Subject to any disclaimer, the term of this patent is extended or adjusted under 35 U.S.C. 154(b) by 319 days.

(21) Appl. No.: 12/245,290

(22) Filed: Oct. 3, 2008

(65) Prior Publication Data

US 2009/0319159 A1 Dec. 24, 2009

Related U.S. Application Data

(60) Provisional application No. 61/075,131, filed on Jun. 24, 2008.

(51) Int. Cl.
*F02D 45/00* (2006.01)
*F02D 41/00* (2006.01)

(52) U.S. Cl. ..... 701/108

(58) Field of Classification Search ..... 701/108, 701/109, 110, 114; 123/568.21, 568.11, 123/568.27, 436
See application file for complete search history.

(56) References Cited

U.S. PATENT DOCUMENTS

| | | | | |
|---|---|---|---|---|
| 6,220,225 | B1 * | 4/2001 | Mencher et al. | 123/491 |
| 7,104,260 | B2 * | 9/2006 | Nakazawa et al. | 123/568.21 |
| 7,275,525 | B2 * | 10/2007 | Miyasako et al. | 701/108 |
| 7,725,244 | B2 * | 5/2010 | Itoga et al. | 701/108 |
| 2010/0274464 | A1 * | 10/2010 | Ramappan et al. | 701/103 |

FOREIGN PATENT DOCUMENTS

| | | | |
|---|---|---|---|
| CN | 1721683 | A | 1/2006 |
| EP | 1612391 | A2 | 1/2006 |
| JP | 2001123871 | A | 5/2001 |
| JP | 2002-364450 | A * | 12/2002 |
| JP | 2009-91993 | A * | 4/2009 |

* cited by examiner

*Primary Examiner* — Hieu T Vo

(57) ABSTRACT

An engine control system comprises a ringing index (RI) determination module and an exhaust gas recirculation (EGR) control module. The RI determination module determines at least one RI based on at least one pressure in at least one cylinder. The EGR control module actuates an EGR valve based on the RI.

19 Claims, 3 Drawing Sheets

ACTIVE COMBUSTION CONTROL BASED ON RINGING INDEX FOR REDUCING HOMOGENOUS CHARGE COMPRESSION IGNITION (HCCI) COMBUSTION NOISE

CROSS-REFERENCE TO RELATED APPLICATIONS

This application claims the benefit of U.S. Provisional Application No. 61/075,131, filed on Jun. 24, 2008. The disclosure of the above application is incorporated herein by reference.

FIELD

The present disclosure relates to engine combustion control and more particularly to engine combustion control in a homogenous charge compression ignition (HCCI) engine system.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

Homogenous charge compression ignition (HCCI) engines combust an air/fuel mixture within cylinders to push pistons toward bottom dead centre (BDC), thereby producing drive or mechanical torque. At low to medium engine loads and low to medium engine speeds (RPMs), the air/fuel mixture is automatically ignited when compressed by the pistons (i.e., an HCCI engine system is operating in an auto-ignited, or HCCI, combustion mode). Otherwise, the air/fuel mixture is ignited via spark plugs (i.e., the HCCI engine system is operating in a spark-ignited combustion mode). The HCCI combustion mode improves efficiency and fuel economy of the engine.

Engine control systems have been developed to control combustion (e.g., to manage air/fuel charge and ignition timing) to achieve the HCCI and the spark-ignited combustion modes. The HCCI combustion mode is limited to low and medium engine loads to protect the engine from damage due to rapid pressure increases and to limit combustion noise created by the engine. Traditional engine control systems, however, do not limit combustion noise as accurately as desired. For example, in those systems, the HCCI combustion mode is not limited by ambient conditions (i.e., barometric pressure, temperature, and humidity) and fuel type, which may vary combustion noise.

SUMMARY

An engine control system comprises a ringing index (RI) determination module and an exhaust gas recirculation (EGR) control module. The RI determination module determines at least one RI based on at least one pressure in at least one cylinder. The EGR control module actuates an EGR valve based on the RI.

A method of operating an engine control system comprises determining at least one RI based on at least one pressure in at least one cylinder; and actuating an EGR valve based on the RI.

Further areas of applicability of the present disclosure will become apparent from the detailed description provided hereinafter. It should be understood that the detailed description and specific examples are intended for purposes of illustration only and are not intended to limit the scope of the disclosure.

BRIEF DESCRIPTION OF THE DRAWINGS

The present disclosure will become more fully understood from the detailed description and the accompanying drawings, wherein.

DETAILED DESCRIPTION

Figure 1:
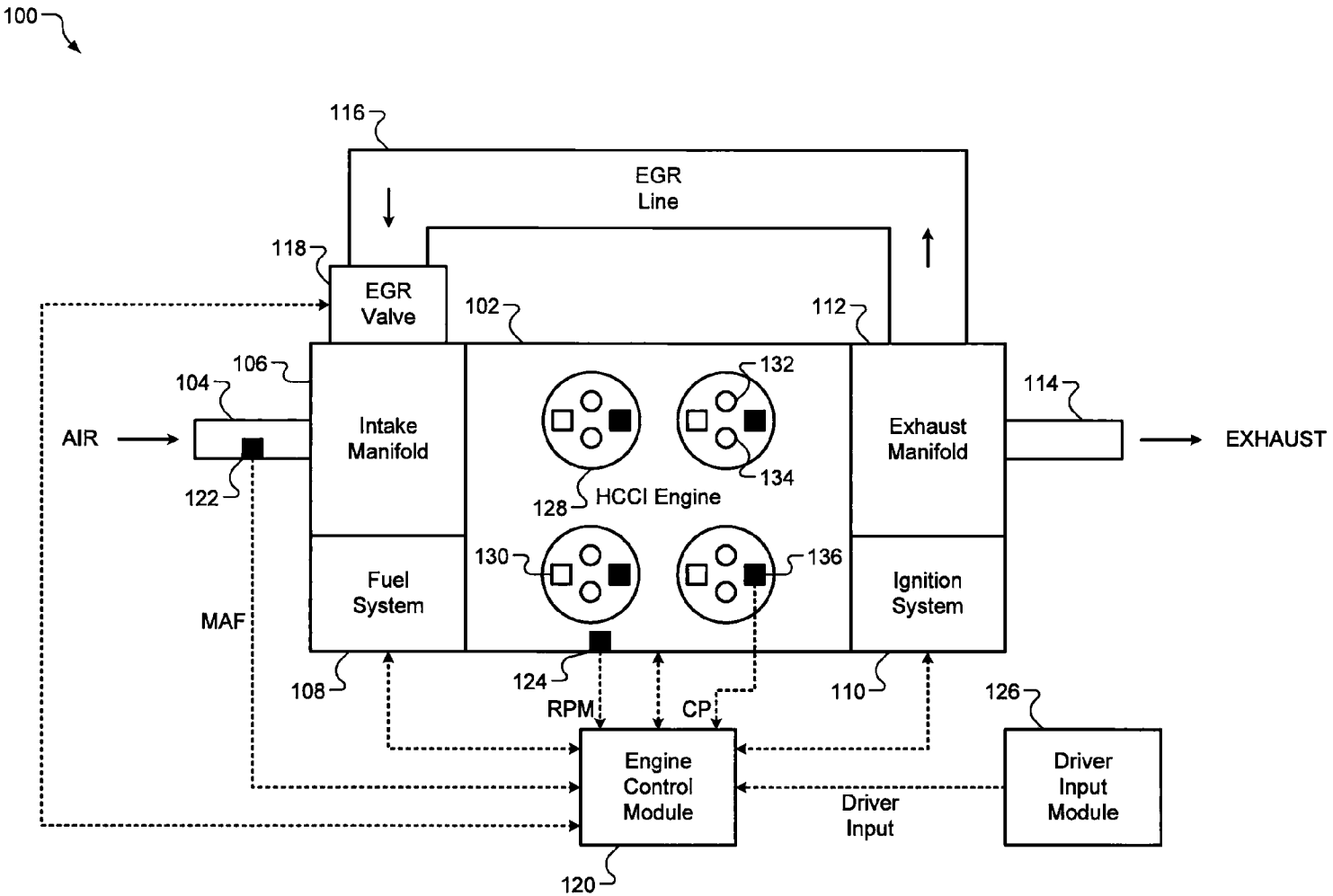
FIG. 1 is a functional block diagram of an exemplary implementation of a homogenous charge compression ignition (HCCI) engine system according to the principles of the present disclosure.

The following description is merely exemplary in nature and is in no way intended to limit the disclosure, its application, or uses. For purposes of clarity, the same reference numbers will be used in the drawings to identify similar elements. As used herein, the phrase at least one of A, B, and C should be construed to mean a logical (A or B or C), using a non-exclusive logical or. It should be understood that steps within a method may be executed in different order without altering the principles of the present disclosure.

As used herein, the term module refers to an Application Specific Integrated Circuit (ASIC), an electronic circuit, a processor (shared, dedicated, or group) and memory that execute one or more software or firmware programs, a combinational logic circuit, and/or other suitable components that provide the described functionality.

To accurately reduce combustion noise created by a homogenous charge compression ignition (HCCI) engine, an engine control system of the present disclosure controls combustion based on a ringing index (RI) of each cylinder within the engine. The RI is an index value that indicates an intensity of combustion noise created by a cylinder. If any of the RIs exceed a corresponding threshold, the engine control system increases an amount of exhaust gas recirculation (EGR) in an HCCI engine system to slow combustion. This decreases the RIs (i.e., combustion noise).

Referring to FIG. 1, an exemplary implementation of an HCCI engine system 100 is shown. The HCCI engine system 100 includes an HCCI engine 102, an inlet 104, an intake manifold 106, a fuel system 108, an ignition system 110, an exhaust manifold 112, an outlet 114, an EGR line 116, an EGR valve 118, an engine control module 120, a mass air flow (MAF) sensor 122, an engine speed (RPM) sensor 124, and a driver input module 126. The HCCI engine 102 includes cylinders 128, spark plugs 130, intake valves 132, exhaust valves 134, and pressure sensors 136.

The HCCI engine 102 combusts an air/fuel mixture to produce a drive torque or a mechanical torque. Air is drawn into the HCCI engine 102 through the inlet 104 and the intake manifold 106. Air within the HCCI engine 102 is distributed into the cylinders 128.

The intake valves 132 selectively open and close to enable air to enter the cylinders 128. Although FIG. 1 depicts four cylinders, it should be appreciated that the HCCI engine 102 may include additional or fewer cylinders. For example, engines having 2, 3, 4, 5, 6, 10, 12 and 16 cylinders are contemplated.

The fuel system 108 may inject fuel into the intake manifold 106 at a central location or may inject fuel into the intake manifold 106 at multiple locations. Alternatively, the fuel system 108 may inject fuel directly into the cylinders 128. The air mixes with the injected fuel and creates the air/fuel mixture in the cylinders 128.

Pistons (not shown) within the cylinders 128 compress the air/fuel mixture. At low to medium engine loads and low to medium RPMs, the air/fuel mixture is automatically ignited when compressed (i.e., the HCCI engine system 100 is operating in an auto-ignited, or HCCI, combustion mode). Otherwise, the ignition system 110 ignites the air/fuel mixture via the spark plugs 130 (i.e., the HCCI engine system 100 is operating in a spark-ignited combustion mode). The low to medium engine loads and the low to medium RPMs are predetermined values. The combustion of the air/fuel mixture drives the pistons down, thereby driving a crankshaft (not shown) and producing the drive torque or the mechanical torque.

Combustion exhaust within the cylinders 128 may be forced out through the exhaust manifold 112 and the outlet 114 when at least one of the exhaust valves 134 are in an open position. The EGR line 116 and the EGR valve 118 may introduce exhaust gas into the intake manifold 106. The EGR line 116 extends from the exhaust manifold 112 to the EGR valve 118, and the EGR valve 118 is mounted on the intake manifold 106. The EGR line 116 transfers exhaust gas from the exhaust manifold 112 to the EGR valve 118. The EGR valve 118 selectively opens and closes to enable exhaust gas to enter the intake manifold 106.

The engine control module 120 controls operation of the HCCI engine system 100 based on various engine operating parameters. The engine control module 120 controls and communicates with the HCCI engine 102, the fuel system 108, the ignition system 110, and the EGR valve 118. The engine control module 120 is further in communication with the MAF sensor 122 that generates an MAF signal based on a mass of air flow into the intake manifold 106.

The engine control module 120 is further in communication with the RPM sensor 124 that generates an RPM signal based on a speed of the HCCI engine 102 in revolutions per minute. The engine control module 120 is further in communication with the driver input module 126 that generates a driver input signal based on, for example, an accelerator pedal position. The engine control module 120 is further in communication with the pressure sensors 136 that each generates a cylinder pressure (CP) signal based on a pressure in one of the cylinders 128. The pressure sensors 136 are located such that the pressure in each of the cylinders 128 may be measured.

Figure 2:
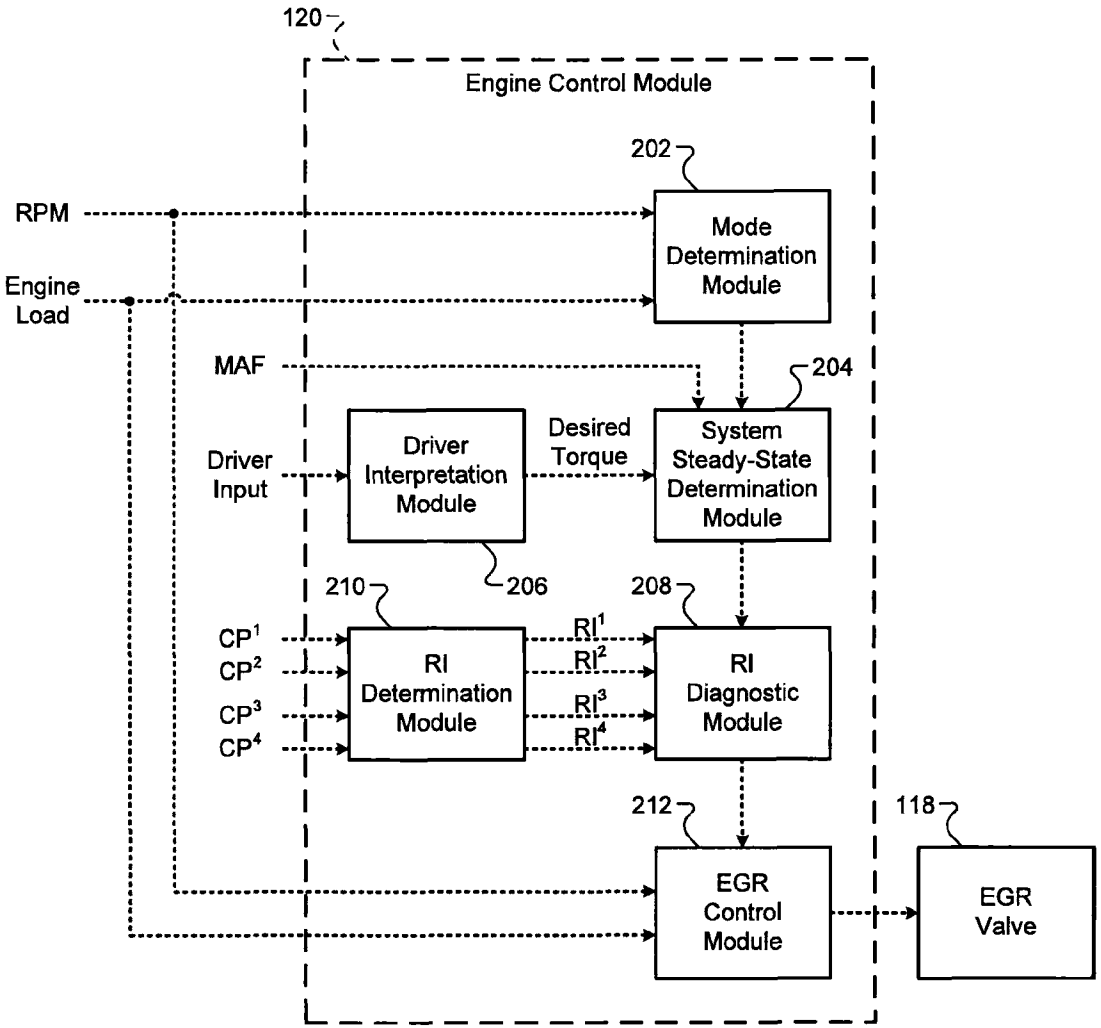
FIG. 2 is a functional block diagram of an exemplary implementation of an engine control module according to the principles of the present disclosure.

Referring now to FIG. 2, an exemplary implementation of the engine control module 120 is shown. The engine control module 120 includes a mode determination module 202, a system steady-state determination module 204, a driver interpretation module 206, an RI diagnostic module 208, an RI determination module 210, and an EGR control module 212. The mode determination module 202 receives the RPM signal and an engine load signal that is generated by the HCCI engine 102 based on a load on the HCCI engine 102.

The mode determination module 202 determines whether the HCCI engine system 100 is operating in the HCCI combustion mode based on the RPM and the engine load. When the HCCI engine system 100 is determined to be operating in the HCCI combustion mode, the mode determination module 202 enables the system steady-state determination module 204. The driver interpretation module 206 receives the driver input signal and determines a desired torque for the HCCI engine 102 to produce based on the driver input.

When enabled, the system steady-state determination module 204 receives the desired torque and the MAF signal. The system steady-state determination module 204 determines whether the HCCI engine system 100 is in a steady-state operating condition based on the desired torque and the MAF. When the desired torque and the MAF are stable in value (i.e., not changing in value more than a predetermined value), the HCCI engine system 100 is determined to be in the steady-state operating condition. When the HCCI engine system 100 is determined to be in the steady-state operating condition, the system steady-state determination module 204 enables the RI diagnostic module 208.

The RI determination module 210 receives the CP signals (i.e., $CP^1$, $CP^2$, $CP^3$ and $CP^4$) and determines an RI based on one of the CP signals for each of the cylinders 128. When the HCCI engine system 100 is operating in the HCCI combustion mode, the RI is typically greater than 1. When the HCCI engine system 100 is operating in the spark-ignited combustion mode, the RI is typically less than 1.

When enabled, the RI diagnostic module 208 receives the RIs (i.e., $RI^1$, $RI^2$, $RI^3$ and $RI^4$) and determines an RI average (i.e., a running average of one of the RIs) for each of the cylinders 128 at each engine cycle. An RI average $RI^i_{avg}$ is determined according to the following equation:

$$RI^i_{avg} = \frac{RI^i(k) + RI^i(k-1) + \ldots + RI^i(k-n-1)}{n}, \quad (1)$$

where i is a cylinder number, k is a current engine cycle, and n is a number of samples for which the running average is determined. The RI diagnostic module 208 determines an RI threshold based on the cylinder number and the number of samples for which the running average is determined for each of the cylinders 128. The RI threshold is determined based on a predetermined table that relates the RI threshold to the cylinder number and the number of samples. For example only, the RI threshold may be determined according to the following table:

| | i | | | |
|---|---|---|---|---|
| n (samples) | 1 | 2 | 3 | 4 |
| 1000 | 3 | 3 | 3 | 3 |
| 1400 | 4 | 4 | 4 | 4 |
| 1800 | 5 | 5 | 5 | 5 |
| 2200 | 5 | 5 | 5 | 5 |
| 2600 | 5 | 5 | 5 | 5 |

The RI diagnostic module 208 compares each of the RI averages to the corresponding RI threshold. If any of the RI averages is greater than the corresponding RI threshold, the RI diagnostic module 208 enables the EGR control module 212. When enabled, the EGR control module 212 receives the RPM signal and the engine load signal.

The EGR control module 212 determines a combustion timing, or a position of the pistons (i.e., a crank angle after top dead center) in which 50 percent of combustion has taken place, based on the RPM and the engine load. The combustion timing may be called CA50. Top dead center is a position of the pistons in which they are furthest from the crankshaft. The combustion timing is determined based on a predetermined table that relates the combustion timing to the RPM and the engine load.

The EGR control module 212 compares the combustion timing to a maximum combustion timing that the combustion timing may be retarded (i.e., increased) to. The maximum combustion timing is predetermined based on a maximum engine speed and a maximum engine load allowed in the HCCI combustion mode. If the combustion timing is less than the maximum combustion timing, the EGR control module 212 increments an amount of EGR in the HCCI engine system 100. In other words, the EGR control module 212 increases an amount of exhaust gas that flows through the EGR valve 118 or an open position of the EGR valve 118. Increasing an amount of exhaust gas in the intake manifold 106 retards the combustion timing (i.e., slows combustion), which in turn decreases the RIs of the cylinders 128 (i.e., combustion noise of the HCCI engine 102).

Figure 3:
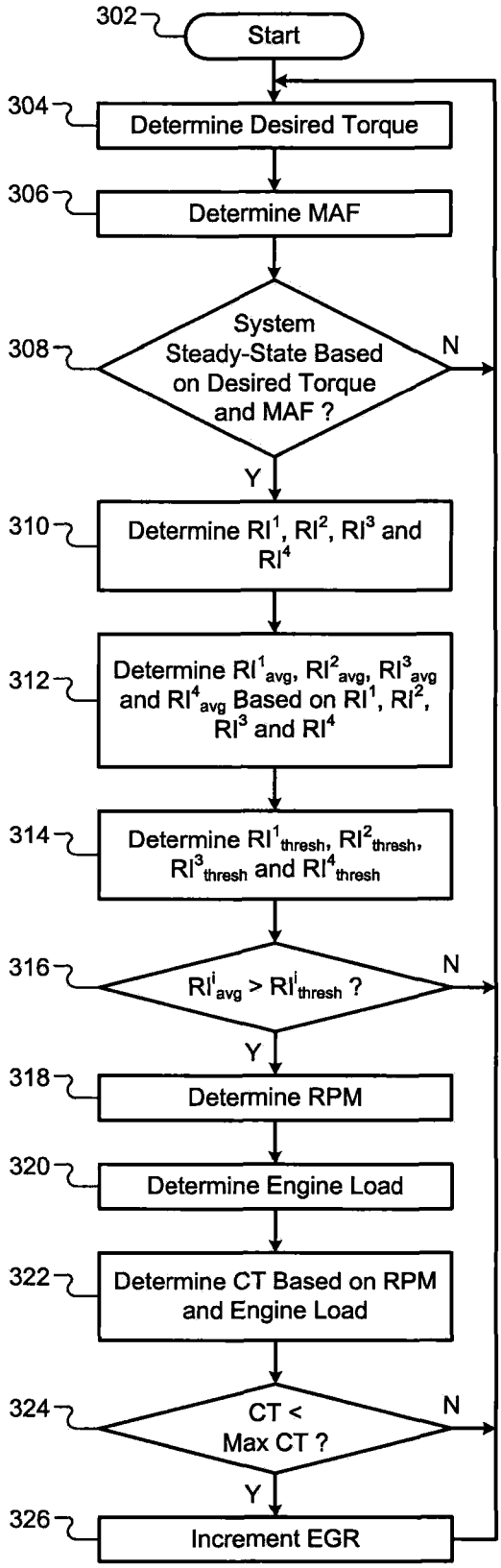
FIG. 3 is a flowchart depicting exemplary steps performed by the engine control module when the HCCI engine system is operating in an HCCI combustion mode according to the principles of the present disclosure.

Referring now to FIG. 3, a flowchart depicting exemplary steps performed by the engine control module 120 when the HCCI engine system 100 is operating in the HCCI combustion mode is shown. Control begins in step 302. In step 304, the desired torque is determined.

In step 306, the MAF is determined. In step 308, control determines whether the HCCI engine system 100 is in the steady-state operating condition (i.e., System Steady-State) based on the desired torque and the MAF. If true, control continues in step 310. If false, control returns to step 304.

In step 310, the RIs are determined. In step 312, the RI averages (i.e., $RI^1_{avg}$, $RI^2_{avg}$, $RI^3_{avg}$ and $RI^4_{avg}$) are determined based on the RIs. In step 314, the RI thresholds (i.e., $RI^1_{thresh}$, $RI^2_{thresh}$, $R^3_{thresh}$ and $RI^4_{thresh}$) are determined. In step 316, control determines whether any of the RI averages (i.e., $RI^i_{avg}$) is greater than the corresponding RI threshold (i.e., $RI^i_{thresh}$). If true, control continues in step 318. If false, control returns to step 304.

In step 318, the RPM is determined. In step 320, the engine load is determined. In step 322, the combustion timing (i.e., CT) is determined based on the RPM and the engine load. In step 324, control determines whether the combustion timing is less than the maximum combustion timing (i.e., Max CT). If true, control continues in step 326. If false, control returns to step 304. In step 326, the amount of EGR (i.e., EGR) is incremented. Control returns to step 304.

Those skilled in the art can now appreciate from the foregoing description that the broad teachings of the disclosure can be implemented in a variety of forms. Therefore, while this disclosure includes particular examples, the true scope of the disclosure should not be so limited since other modifications will become apparent to the skilled practitioner upon a study of the drawings, the specification, and the following claims.

What is claimed is:

1. An engine control system, comprising:

a ringing index (RI) determination module that determines at least one RI based on at least one pressure in at least one cylinder; and an exhaust gas recirculation (EGR) control module that actuates an EGR valve based on the RI.

2. The engine control system of claim 1 wherein the EGR control module actuates the EGR valve based on the RI when a homogenous charge compression ignition (HCCI) engine system is operating in an auto-ignited combustion mode.

3. The engine control system of claim 1 wherein the EGR control module actuates the EGR valve based on the RI when an HCCI engine system is in a steady-state operating condition.

4. The engine control system of claim 3 further comprising a steady-state determination module that determines whether the HCCI engine system is in the steady-state operating condition based on a desired torque and a mass of airflow into an intake manifold.

5. The engine control system of claim 1 wherein the EGR control module actuates the EGR valve when at least one running average of the RI is greater than at least one threshold of the RI.

6. The engine control system of claim 5 further comprising an RI diagnostic module that determines the threshold based on a cylinder number of the RI and a number of samples for which the running average is determined.

7. The engine control system of claim 1 wherein the EGR control module actuates the EGR valve based on the RI when a combustion timing is less than a maximum combustion timing.

8. The engine control system of claim 7 wherein the maximum combustion timing is predetermined based on a maximum engine speed and a maximum engine load allowed when an HCCI engine system is operating in an auto-ignited combustion mode.

9. The engine control system of claim 1 wherein the EGR control module increases an amount of exhaust gas that flows through the EGR valve based on the RI.

10. The engine control system of claim 1 wherein the EGR control module increases an open position of the EGR valve based on the RI.

11. A method of operating an engine control system, comprising:

determining at least one RI based on at least one pressure in at least one cylinder; and actuating an EGR valve based on the RI.

12. The method of claim 11 further comprising actuating the EGR valve based on the RI when a homogenous charge compression ignition (HCCI) engine system is operating in an auto-ignited combustion mode.

13. The method of claim 11 further comprising actuating the EGR valve based on the RI when an HCCI engine system is in a steady-state operating condition.

14. The method of claim 13 further comprising determining whether the HCCI engine system is in the steady-state operating condition based on a desired torque and a mass of airflow into an intake manifold.

15. The method of claim 11 further comprising actuating the EGR valve when at least one running average of the RI is greater than at least one threshold of the RI.

16. The method of claim 15 further comprising determining the threshold based on a cylinder number of the RI and a number of samples for which the running average is determined.

17. The method of claim 11 further comprising actuating the EGR valve based on the RI when a combustion timing is less than a maximum combustion timing.

18. The method of claim 11 further comprising increasing an amount of exhaust gas that flows through the EGR valve based on the RI.

19. The method of claim 11 further comprising increasing an open position of the EGR valve based on the RI.

* * * * *